United States Patent [19]

Franzino

[11] Patent Number: 4,508,124

[45] Date of Patent: Apr. 2, 1985

[54] HAIR CURLING SPOOL HOLDER

[76] Inventor: Peter L. Franzino, 2556 Stein St., Jacksonville, Fla. 32216

[21] Appl. No.: 525,976

[22] Filed: Aug. 24, 1983

[51] Int. Cl.[3] ..... A45D 2/26

[52] U.S. Cl. ..... 132/41 R

[58] Field of Search ..... 132/41, 42, 46 R, 48 R, 132/33 R

[56] References Cited

U.S. PATENT DOCUMENTS

| | | | |
|---|---|---|---|
| 2,145,539 | 1/1939 | Bottorf | 132/41 R |
| 2,829,654 | 4/1958 | Fay | 132/41 R |
| 2,998,015 | 8/1961 | Gresham et al. | 132/48 R |
| 3,073,318 | 1/1963 | Catania | 132/41 R |

*Primary Examiner*—Gregory E. McNeill

*Attorney, Agent, or Firm*—Arthur G. Yeager

[57] ABSTRACT

A hair curling spool holder including two mating arcuate half sections pivotally joined with spring biasd finger grips urging the two half sections closed along a longitudinal line; each section comprising a body portion of a plurality of spaced curved comb teeth adapted to encircle a heated spool around which hair has been wound for being curled; the teeth being adapted to interlock with teeth of the opposing half section so as to maintain the hair around the roller without damage thereto.

14 Claims, 11 Drawing Figures

FIG. 7
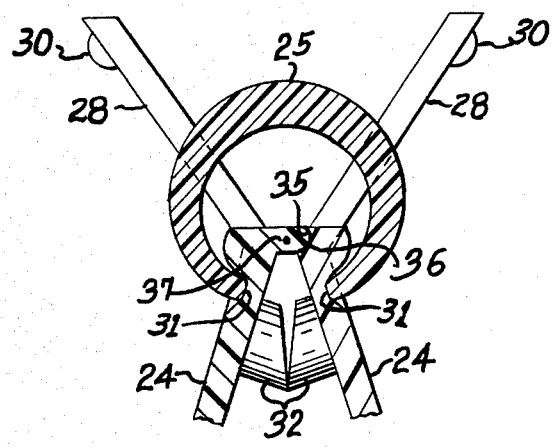
FIG. 8
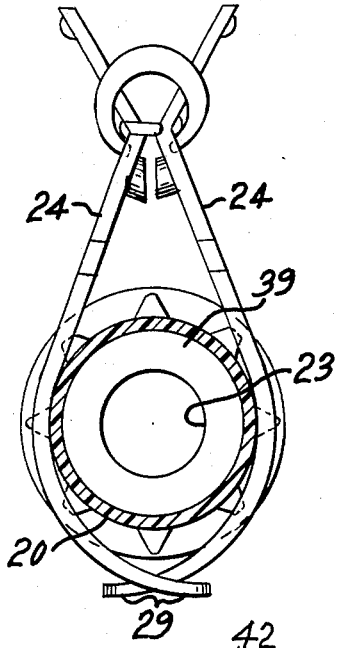
FIG. 9
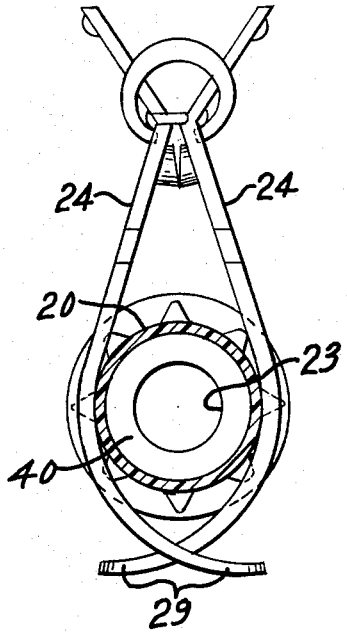
FIG. 10
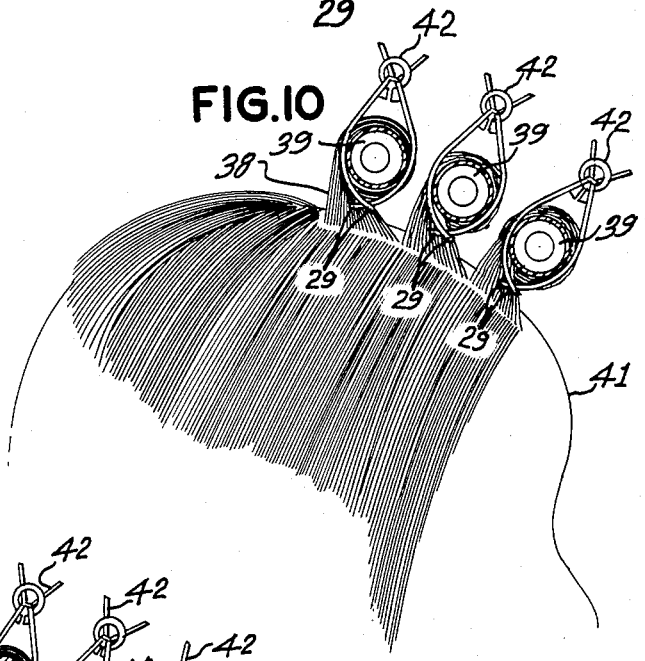
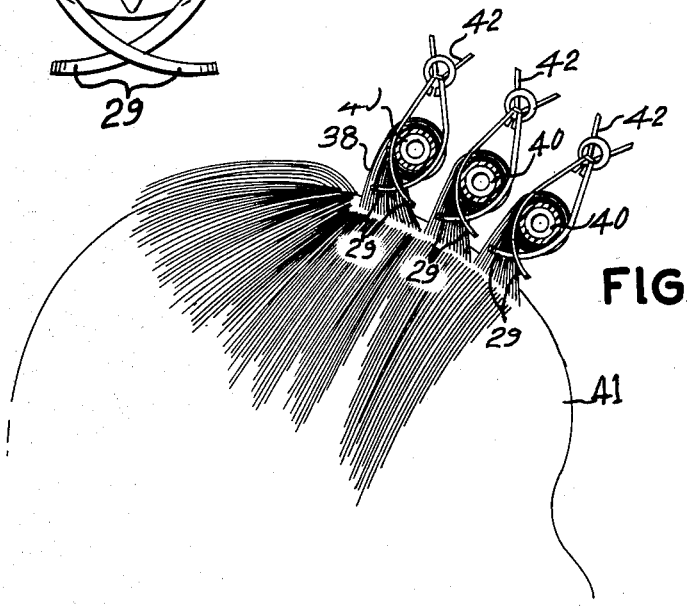
FIG. 11

HAIR CURLING SPOOL HOLDER

BACKGROUND OF THE INVENTION

For several years there have been sold to the public hair curling devices which involve a plurality of spools that are heated, portions of hair are wrapped around each spool, with or without treatment lotions being applied thereto, and the spool and hair are held in place until the curling is completed. The devices of the past have suffered from one or more of several deficiencies which have caused problems of various sorts in the use of these devices. In some instances a U-shaped clip, or the like, has been employed to encircle the spool after the hair has been rolled onto the spool, and because this clip has been made of metal it transmits heat so readily to the scalp of the user that a burning sensation has resulted. Furthermore such clips have been so designed that they fail to remain in place for the necessary period of time while the user goes about her normal daily routine involving many movements of the head which tends to loosen the roller and its attachment clip. In other instances the clips or holders that are applied to the spool to keep the hair in place have covered so much of the hair that the subsequent application of lotions has resulted in not all of the hair being reached by the treating lotion.

In my co-pending application Ser. No. 504,446, filed on or about June 15, 1983 entitled "Hair Curling Spool Holder" which is a continuation of Ser. No. 352,851 filed Feb. 26, 1982 entitled "Hair Curling Spool Holder" there is disclosed an improved spool holder comprising two half sections with finger grips and spring means adapted to allow the two halfs to be opened by pressing the finger grips together and when released close around the hair rolled onto the spool with interlocking prongs that hold the two halves together so as to maintain the hair on the roller without danger of becoming loose. Furthermore the device of my previous invention provides adequate access to permit hair treating lotions to be applied to all the hair wrapped on the roller and at the same time to prevent the transfer of any undue amount of heat from the roller to the scalp of the user.

The present invention provides an improvement over my previous invention described above in that it includes a more positive interlocking action to maintain the holder in place on the roller and to prevent it from becoming loosened by the normal activities of the person wearing the roller and holder. Furthermore the present invention is a more simplified design in that each of the two halves of the holder are identical. It is therefore an object of this invention to provide an improved hair curling clip or holder adapted to be used with a heated spool of the prior art. It is another object of this invention to provide an improved hair curling spool holder that does not permit slippage of the spool and of the hair on the spool once it has been arranged. It is still another object of this invention to provide an improved hair curling spool holder that eliminates damage to the hair and burning of the scalp. Still other objects of this invention will be apparent from the more detailed description which follows.

BRIEF DESCRIPTION OF THE INVENTION

This invention provides a hair curling spool holder for releasable attachment about a heatable cylindrical spool having a longitudinal axis and onto which hair is wrapped therearound with upstanding hair engaging nibs on its outer surface and an outwardly extending flange at each end, the improvement comprising a pair of identical mating half sections each having a finger grip portion, a body portion for encircling at least one-half of a spool, and an intermediate portion joining said body portion to said finger grip portion, said half sections being pivotal along a pivotal axis adjacent said finger grip portions to open and close said body portions along a longitudinal line parallel to a spool longitudinal axis to be respectively removed from or closely encircle a spool, said longitudinal line being closely adjacent an outer surface of a spool, said pivotal axis being parallel to said longitudinal line and a longitudinal axis of a spool and being spaced remote from an outer surface of a spool, each said section having a plurality of spaced, curved, flexible teeth extending from said longitudinal line to said intermediate portion, said sections when mated having said spaced teeth in interlocking relationship to provide lateral engagement therebetween to close said holder around a spool and to engage hair of a user without damage thereto whereby a spool with hair wrapped thereon is engaged by said holder and maintained in position on the head of a user.

In the preferred embodiments of this invention a stop member is provided on the inside of each half section such that when the two stop members contact each other they will prevent the two half sections from closing any further. In still another embodiment of this invention mating concave and convex sections are integrally formed along the pivotal axis such that when the two half sections are assembled to form the holder of this invention these concave and convex sections form hinges when the spring means are attached to urge the two half sections toward each other.

BRIEF DESCRIPTION OF THE DRAWINGS

The novel features believed to be characteristic of this invention are set forth with particularity in the appended claims. The invention itself, however, both as to its organization and method of operation together with further objects and advantages thereof, may best be understood by reference to the following description taken in connection with the accompanying drawings in which:

FIG. 7 is a cross-sectional view taken at 7—7 of FIG. 1 when the spool holder is in the closed position of FIG. 4.

FIG. 8 is an end view in elevation of the spool holder of this invention encircling a large diameter spool.

FIG. 9 is an end view in elevation of the spool holder of this invention encircling a small spool of the prior art.

FIG. 10 is a schematic view of spool holders of this invention being employed with large diameter spools as in FIG. 8.

FIG. 11 is a schematic view of the spool holder of this invention being employed with small diameter spools as shown in FIG. 9.

DETAILED DESCRIPTION OF THE INVENTION

Figure 5:
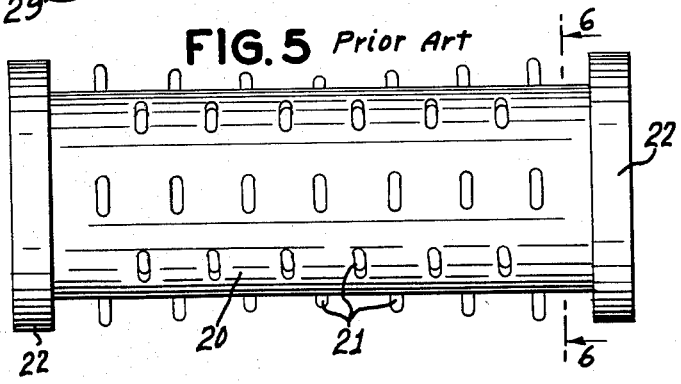
FIG. 5 Prior Art
FIG. 5 is a front elevation view of a spool of the prior art.
Figure 6:
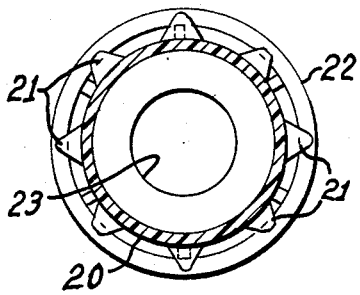
FIG. 6 Prior Art
FIG. 6 is a cross-sectional view taken at 6—6 of FIG. 5.

The holder of this invention is designed to be employed with any of several types of prior art hair curling spools such as those shown in FIGS. 5 and 6. In general these spools have a cylindrical body 20 and two flanges at the end portions of the body to form the typical spool shape and permit hair to wound around the spool between the two end flanges 22. Usually the cylindrical body 20 contains a plurality of nibs 21 projecting upardly from the body to help in spreading the hair evenly over the spool and to maintain it on the spool in a wrapped condition. Normally these spools are sold in sets of a dozen or more in combination with a heating device which comprises a plurality of upstanding cylindrical heating elements with a spool being contacted with each heating element by being placed upright with hole 23 straddling a single heating element. The heating elements and the spools of the prior art form no part of this invention.

In conjunction with the use of each spool there must be a spool holder which is designed to hold the hair of the user onto the spool after it has been wrapped around the spool. The improved holder of this invention is shown in FIGS. 1–4 and 7–11. In FIGS. 1–4 there may be seen the components of the spool holder of this invention. Each spool holder comprises two identical mating half sections 24 attached to each other by means of spring clips 25. Each half section comprises a body portion 26 and an intermediate portion 27 and a finger grip portion 28.

Figure 4:
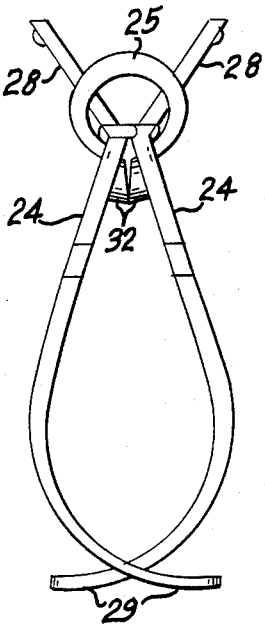
FIG. 4 is an end view of the assembled spool holder of this invention in the closed position.

Body portion 26 is formed of a plurality of parallel spaced flexible comb teeth 29 which are so arranged that when the two half sections 24 are assembled in operating position the teeth of one section 24 will slide in the spaces between adjacent teeth of the opposing section 24 when the spool holder is in the closed position as shown in FIG. 4. Teeth 29 are curved so as to form a closely encircling relationship when placed around the heated spool with hair wrapped around it. Body portion 26 and teeth 29 are so designed that they will enclose at least about one-half of the circumference of the spool when the holder is closed around the spool as may be seen in FIGS. 8 and 9 on different sizes of spools.

Figure 1:
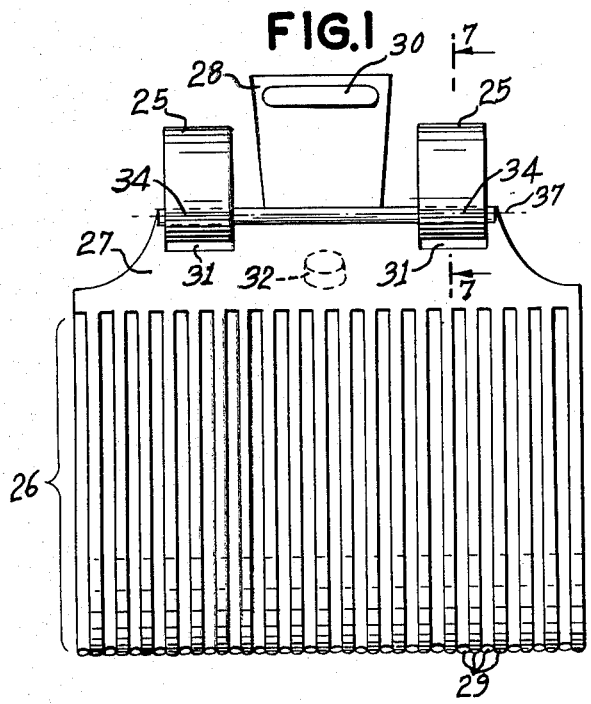
FIG. 1 is a front elevational view of the spool holder of this invention in the opened position.
Figure 2:
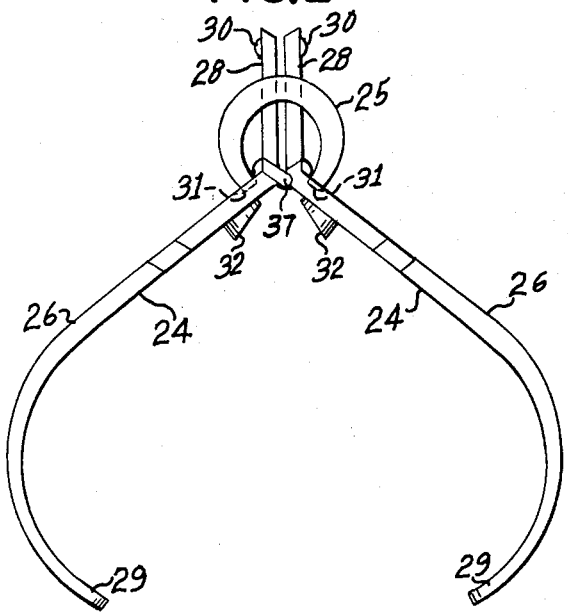
FIG. 2 is an end view in elevation of the spool holder of this invention in the opened position.

Finger grip portions 28 are tabs which may have a raised portion 30 to provide better gripping with the fingers, and the tabs are set an angle such that when pressed together as shown in FIG. 2 they will permit the ends of teeth 29 to be opened far enough to permit a spool with hair attached to pass through that opening. Intermediate portion 27 is a solid portion which forms the base to which finger grip 28 is attached and also serves as the back supporting comb teeth 29.

Spring means 25 are shown as two split-ring spring clips which seat themselves in recesses 31 formed in intermediate portion 27.

Positioned on the inside surface of intermediate portion 27 adjacent finger grip portion 28 is a stop member 32 formed as an outward projection on each of half sections 24. Stop members 32 are positioned so as to contact each other when half sections 24 are closed upon each other and will prevent any further closing movement as may be seen in FIG. 4.

Figure 3:
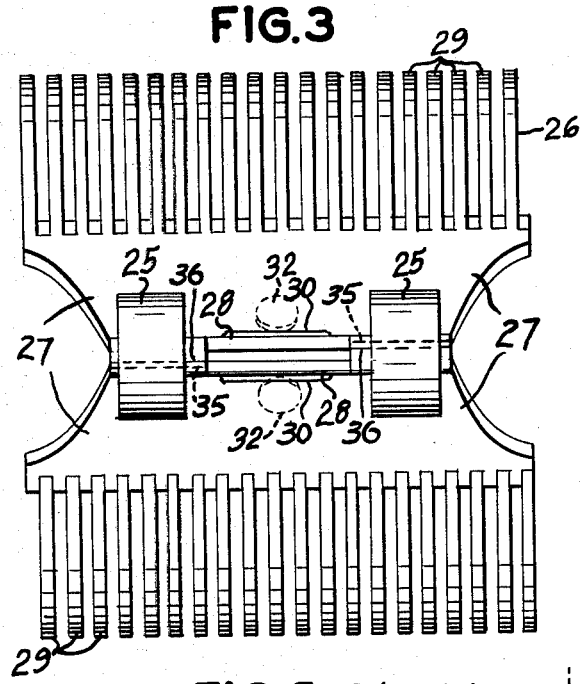
FIG. 3 is a top plan view of the spool holder of this invention in the opened position.

Spaced hinge members 34 are integrally formed along the upper edge of intermediate portion 27 adjacent the two ends of a pivotal axis 37 about which two half sections 24 pivot or move in a ball-and-socket manner with respect to each other. The structural features of hinge members 34 are best seen in the cross-sectional view of FIG. 7. Each half section 24 is identical with a semi-cylindrical convex section 35 at one end of the pivotal axis 37 and a concave grooved portion 36 at the other end of pivotal axis 37 as seen in FIG. 3. These two portions are formed symmetrically about the center line of each half section 24 such that when they are assembled in opposing relationship as shown in FIG. 7 the concave portion 36 of one section 24 will mate with the convex section 35 of the other section 24 to form a hinge member 34 at each end of pivotal axis 37. Spring clips 25 urge the two portions of hinge members 34 together so that they operate in a pivotable manner.

Spring clip seats 31 and hinge members 34 are positioned such that spring clips 25 urge half sections 24 to close on each other in all positions except the fully open position (FIG. 2) in which half sections 24 are biased to remain open. This double action is due to the different positions of the pivotal axis 37 with respect to seats 31 when half sections 24 are fully open, partially open, or closed. In the closed position as seen in FIG. 7 pivotal axis 37 is located vertically above seats 31 which causes the horizontal force vectors exerted by clips 25 to be directed below axis 37 urging half sections 24 to close on each other. In the fully open position of the holder shown in FIG. 2, axis 37 is slightly below seats 31 of spring clips 25 and the horizontal force vectors exerted by clips 25 are directed above axis 37 urging half sections 24 to remain open. In nearly all positions between the fully open position and the closed position of half sections 24, spring clips 24 urge half sections to close on each other. Only a very slight movement from the fully open position is sufficient to bias spring clips 25 to urge half sections 24 to close on each other. This feature provides a distinct advantage in assuming proper positioning of the holder about the hair and spool or rollers before closure of the holder therearound and to permit the user easily to press the comb portion 26 and/or intermediate portion 27 firmly about the hair and spool with the interlocking of the comb teeth 29 as illustrated in FIGS. 8–11.

In FIGS. 8 and 9 there are shown the spool holder of this invention employed with two different sizes of spools. In FIG. 8 the spool 39 is larger in diameter than spool 40 shown in FIG. 9. The only difference in results when these two different sizes of spools are used is that the individual teeth 29 of the two half sections 24 overlap less in FIG. 8 than they do in FIG. 9. In both instances the teeth from the two sections 24 interlock with each other and form a snug fit around the spool and any hair that is rolled around the spool.

It is an advantage of this invention that one spool holder is suitable for use with any of several sizes of rollers available on the market. This is due to the curvature of the comb teeth 29 which hold long or short hair tightly against any roller used, and at the same time holding the roller away from the scalp so as to prevent any burning of the scalp, and without the necessity of using small pieces of insulating foam as used in prior art devices. In FIGS. 10 and 11 there is shown the manner in which the spool holders and spools of different sizes may be employed in curling the hair of the person using this invention. In FIG. 10 the hair 38 on the head of user 41 is rolled around spools 39 and held in place with spool holders 42 of this invention. In FIG. 11 hair 38 of user 41 is wrapped around spools 40 and held in place by spool holders 42 of this invention. The difference between the results in FIG. 10 and FIG. 11 is merely that teeth 29 overlap less when used with spool 39 as shown in FIG. 10 than when used with spool 40 in FIG. 11.

While the invention has been described with respect to certain specific embodiments, it will be appreciated that many modifications and changes may be made by those skilled in the art without departing from the spirit of the invention. It is intended, therefore, by appended claims to cover all such modifications and changes as fall within the true spirit and scope of the invention.

What is claimed as new and what is desired to secure by Letters Patent of the United States is:

1. A hair curling spool holder for releasable attachment about a heatable cylindrical spool having a longitudinal axis and onto which hair is wrapped therearound with upstanding hair engaging nibs on its outer surface and an outwardly extending flange at each end, the improvement comprising a pair of identical mating half sections each having a finger grip portion, a body portion for encircling at least one-half of a spool, and an intermediate portion joining said body portion to said finger grip portion, said half sections being pivotal along a pivotal axis adjacent said finger grip portions to open and close said body portions along a longitudinal line parallel to a spool longitudinal axis to be respectively removed from or closely encircle a spool, said longitudinal line being closed adjacent an outer surface of a spool, said pivotal axis being parallel to said longitudinal line and a longitudinal axis of a spool and being spaced remote from an outer surface of a spool, each said section having a plurality of spaced, curved, flexible teeth extending from said longitudinal line to said intermediate portion, said sections when mated having said spaced teeth in interlocking relationship to provide lateral engagement therebetween to close said holder around a spool and to engage hair of a user without damage thereto whereby a spool with hair wrapped thereon is engaged by said holder and maintained in position on a head of a user.

2. The holder of claim 1 comprising spring means associated with said half sections adjacent said pivotal axis to bias the teeth of said half sections to close toward each other, and also to bias said finger grip portions toward each other when said half sections are in the fully open position.

3. The holder of claim 1 wherein said half section body portions extend substantially the same length as a length of a spool.

4. The holder of claim 1 wherein said holder is useable on various diameters of cylindrical spools.

5. The holder of claim 1 wherein each said section includes on its inside surface adjacent said finger grip a stop member adapted to contact the stop member on the other mating section and prevent said sections from closing beyond the position in which the said stop members are in contact with each other.

6. The holder of claim 1 wherein each said section includes along said pivotal axis a concave portion adjacent one end thereof and a convex portion adjacent the other end thereof, said concave portion of one mating section and said convex portion of the other mating section being adapted to mate and form two cooperating hinge seats along said pivotal axis.

7. The holder of claim 6 further comprising a spring means located adjacent each hinge seat biasing said sections toward each other.

8. The holder of claim 2 wherein said spring means is adapted to hold said sections open when said sections are pivoted to the maximum open position.

9. A hair curling spool holder for releasable attachment about a heatable cylindrical spool having a longitudinal axis and onto which hair is wrapped therearound with upstanding hair engaging nibs on its outer surface and an outwardly extending flange at each end, the improvement comprising a pair of identical mating half sections, and spring means biased to hold sections together in opposing relationship, each section having a finger grip portion, a body portion for closely encircling at least one-half of said spool and an intermediate portion joining said body portion to said finger grip portion, said half sections being pivotal along a pivotal axis adjacent said finger grip portion to open and close said body portions along a longitudinal line parallel to said spool longitudinal axis and diametrically opposite to said pivotal axis, said longitudinal line being closely adjacent the outer surface of said spool, said pivotal axis being parallel to said longitudinal line and a longitudinal axis of said spool and being spaced remote from an outer surface of said spool, each body portion consisting essentially of a plurality of spaced, parallel, curved, flexible comb teeth extending from said intermediate portion to said longitudinal line, said sections when mated having said spaced teeth in interlocking relationship to provide lateral engagement therebetween to close said holder around a spool and to engage hair of a user without damage thereto whereby a spool with hair wrapped thereon is engaged by said holder and maintained in position on a head of a user.

10. The holder of claim 9 wherein said spring means are attached to said half sections adjacent said pivotal axis.

11. The holder of claim 9 wherein each said half section has a stop member projecting upwardly from it concave surface adjacent said finger grip portion, said stop members adapted to contact each other when said half sections are closed toward each other and to prevent further closing movement.

12. The holder of claim 9 wherein each said half section includes along said pivotal axis a grooved concave portion adjacent one end thereof and s semicylindrical, convex portion adjacent the other end thereof, each concave portion on one mating half section being adapted to mate with a respective convex portion on the other mating half section to form a pivotable hinge.

13. The holder of claim 9 wherein said spring means comprises two split ring springs seated in respective recesses located in said intermediate portions.

14. The holder of claim 13 wherein said recesses and said pivotal axis are located respectively such that when said half sections are closed or partially open, said spring means applies its biasing force on one side of said axis tending to close the teeth of the half sections toward each other, and when said half sections are fully open with said finger grips pivoted to a close proximity, said spring means applies its biasing force on the opposite side of said axis tending to maintain said half sections in the fully open position.

* * * * *